US005815975A

United States Patent [19]

Rambo et al.

[11] Patent Number: 5,815,975

[45] Date of Patent: Oct. 6, 1998

[54] GUN BORE CLEANING SYSTEM

[75] Inventors: Robert D. Rambo, Sellersville; Berwyn M. Crook, Yardley, both of Pa.

[73] Assignee: Bore Tech, Inc., Colmar, Pa.

[21] Appl. No.: 863,439

[22] Filed: May 27, 1997

[51] Int. Cl.[6] ..... F41A 29/00

[52] U.S. Cl. ..... 42/95

[58] Field of Search ..... 42/95; 15/104.03, 15/104.05

[56] References Cited

U.S. PATENT DOCUMENTS

| | | | |
|---|---|---|---|
| 1,050,678 | 1/1913 | Moreno | 423/32 |
| 2,409,916 | 10/1946 | Vandoe | 15/104.165 |
| 4,399,627 | 8/1983 | Malesky et al. | 42/1 BC |
| 4,404,979 | 9/1983 | Hobbs | 134/166 |
| 4,499,625 | 2/1985 | Bottomley | 15/104.165 |
| 4,803,792 | 2/1989 | Brown, Jr. et al. | 42/95 |
| 4,896,447 | 1/1990 | Badoni | 42/95 |
| 5,095,644 | 3/1992 | McCoy | 42/95 |
| 5,588,242 | 12/1996 | Hughes | 42/95 |
| 5,628,136 | 5/1997 | Wickser, Jr. | 42/95 |

*Primary Examiner*—Charles Jordan
*Assistant Examiner*—Meena Chelliah
*Attorney, Agent, or Firm*—Howson and Howson

[57] ABSTRACT

A gun bore cleaning system comprising a cleaning patch guide and holder, and a solvent and patch collector. The guide includes a tube having a tapered bushing at its forward end for abutting the breech end of the bore opening, and an inclined patch support surface near a rearward end holds a cleaning patch. As a cleaning rod is passed through the tube into the bore, it captures the patch, impregnated with a cleaning solvent, and pushes it through the bore into the solvent and patch collector mounted on the muzzle of the gun where the patch and any excess solvent are retained. The solvent and patch collector includes an adaptor mountable on the muzzle and a disposable container removably connected to the adaptor.

19 Claims, 4 Drawing Sheets

FIG. 7
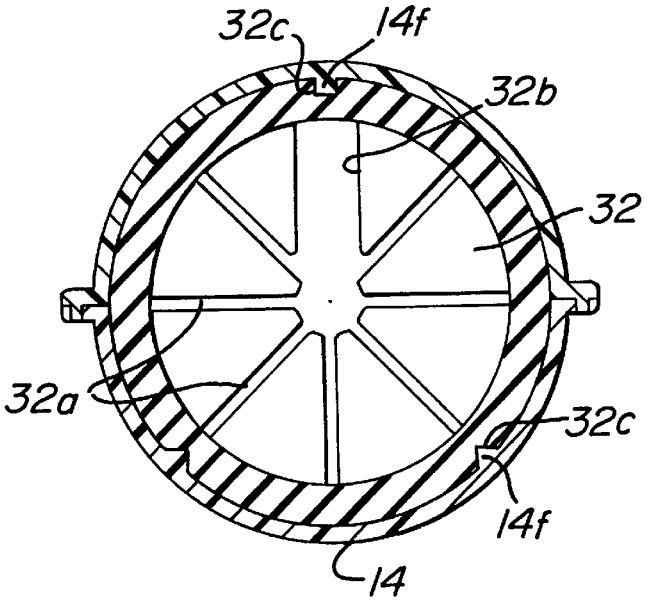
FIG. 8
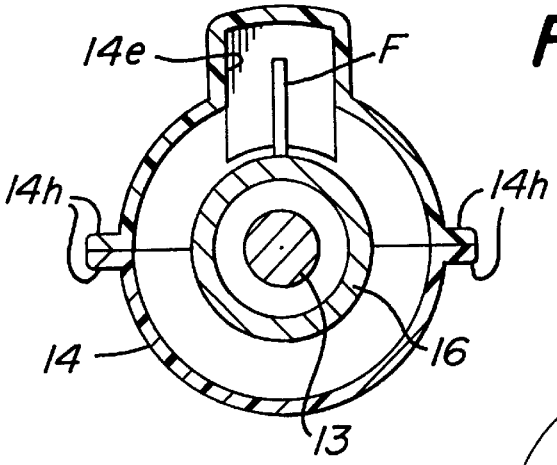
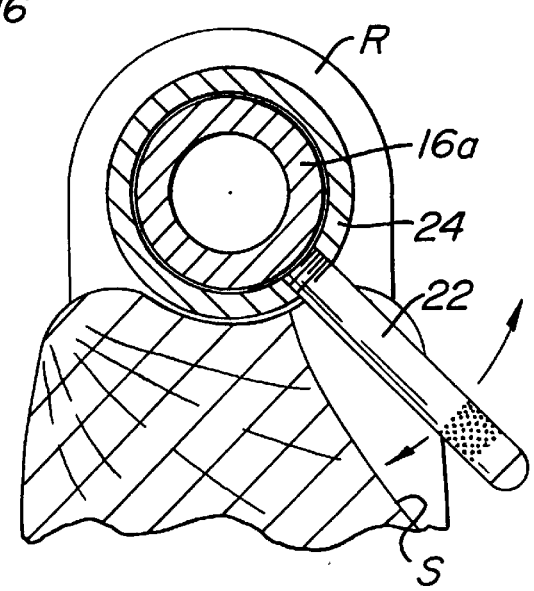
FIG. 4

GUN BORE CLEANING SYSTEM

FIELD OF INVENTION

The present invention relates in general to apparatus for cleaning gun bores, and more particularly to a hands-free brush and patch guide and solvent collection system for use in cleaning the bore of a gun.

BACKGROUND OF THE INVENTION

Cleaning and polishing the bore of a rifle significantly affects shooting accuracy and consistency in addition to preserving the value of the rifle. The sooner copper, powder and lead fouling are removed from the barrel, the easier is the cleaning task. Frequent cleaning is critical, especially in marksmanship competition that requires the rifle bore to be keep a highly polished clean bore as often as every four or five shots. It is also important in competition where the rifle is bench-mounted and rounds are fired in rapid succession.

The cleaning process is quite simple but usually messy. A bore cleaning kit typically includes a steel cleaning rod, wire brushes and jag attachments of appropriate calibre, pre-cut patches or swabs, and cleaning solvent. Immediately after a firing, the bolt is removed and a solvent-bearing brush attached to the end of the cleaning rod is run through the bore to loosen residue. This is followed by a jag-mounted patch permeated with solvent to mop out any loose residue and dirt. Several more clean, solvent-containing patches are run through the bore until a patch comes out clean. If there is heavy fouling, this process can take ten to twenty patches. Of course, it is important, where possible, for the brush and patches to be run through the bore in the breech-to-muzzle direction to insure that no powder residue has been pushed into the breech mechanism that may cause subsequent rounds to stick in the firing chamber or cause the next bullet fired to drag residue and dirt down the barrel and score the bore.

Various bore cleaning devices are presently available for guiding the cleaning rod through the bore. One such device comprises a metal tube with an inside diameter slightly greater than the calibre of the rifle bore. A tapered bushing on the front of the tube abuts the breech end of the bore and is held tightly in place by an arm extending from the tube and bearing against a rifle surface such as the bolt-handle slot in the stock. The position of the arm is adjustable along the length of the tube to accommodate different locations of the bearing surface on various models. The back end of the tube includes an aperture through which cleaning solvent is applied to a brush or patch, secured beforehand on the tip of a cleaning rod, as it passes the aperture on its way into the bore. When the brush or patch exits the muzzle of the rifle, the solvent may splatter and drip onto clothing, floors and exterior surfaces. As the rod is pulled back out of the bore, the solvent-laden patch drops off, and as it is retrieved, dirt and solvent cling to the shooter's hands and invariably find their way onto the rifle barrel and stock, possibly causing corrosion.

OBJECTS OF THE INVENTION

Accordingly, it is an object of the present invention to provide a system for aligning and guiding, substantially hands-free, a wire brush or cleaning patch into the breech end of the bore of a gun and for collecting excess solvent and patches at the muzzle.

Another object of the invention is to provide a brush and patch guide in a gun cleaning apparatus in which a patch permeated with cleaning solvent may be placed on a cleaning rod guide and captured hands-free by the tip of the rod before entering the gun bore.

Still another object of the invention is to provide a gun cleaning rod guide which enables a wire brush or cleaning patch to be fully exposed to a cleaning solvent before being run through a gun bore.

A still further object of the invention is to provide a hands-free solvent and patch collection apparatus in which solvent- and dirt-bearing patches discharged from the muzzle of a gun are prevented from soiling the user or surrounding environment.

A still further object is to provide a gun cleaning system which is quick and easy to install and use, ecologically friendly, and relatively inexpensive to manufacture.

SUMMARY OF THE INVENTION

Briefly, these and other objects of the invention are achieved by a bore cleaning system, suitable for installing on a gun, comprising a patch holder and guide, and a solvent and patch collector. The guide includes a tube with a tapered bushing at one end for abutting the opening of the breech end of the bore, and a platen transverse to the length of the tube having an aperture opening into the tube bore. A patch placed on the platen and impregnated with cleaning solvent is captured by a cleaning rod jag and pushed through the gun bore. The solvent and patch collector includes a hollow cylindrical adaptor with a radially slotted resilient opening at one end which is pressed onto the muzzle of the gun to grip the barrel. The other end tapers to a neck section threadingly connected to the narrow neck of a conventional plastic bottle. An internal recess along the tapered portion of the adaptor accommodates the front sight of the gun.

BRIEF DESCRIPTION OF THE DRAWINGS

For a better understanding of the objects and principles of the invention, reference will be made to the following detailed description taken in conjunction with the accompanying drawings wherein:

FIG. 4 is an enlarged, transverse cross sectional view through the brush and patch guide taken along the line 4—4 of FIG. 3.

FIG. 7 is an enlarged, transverse cross section through the solvent and patch collector taken along the line 7—7 of FIG. 2;

FIG. 8 is an enlarged, transverse cross section of the patch collector taken along the line 8—8 of FIG. 6.

DESCRIPTION OF THE PREFERRED EMBODIMENT

Figure 1:
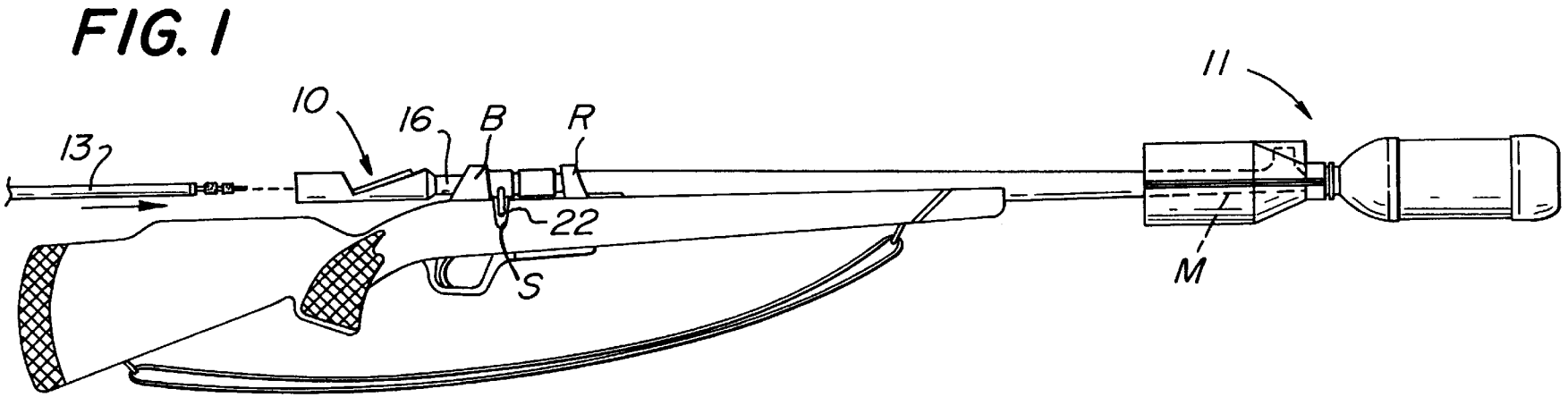
FIG. 1 is a side elevational view of a gun bore cleaning system according to the invention shown installed on a typical bolt-action rifle.

Referring now to the drawings, FIG. 1 illustrates a gun bore cleaning system comprising a patch guide and holder 10 and a solvent and patch collector 11 shown installed on a typical bolt-action rifle, such as a Winchester 70 or Mossberg 810, in which the bolt slides through a bridge B into a ring R of a receiver mechanism. In place of the bolt, guide 10 is installed for slidably axially receiving a cleaning rod 13, and the solvent and patch collector 11 is mounted on the muzzle end.

As best seen in FIGS. 2–5, guide 10 includes an elongate tube 16, having by forward and rearward portions 16*a* and 16*b*, respectively, an intermediate portion 16*c*, and a bore 18 with an inside diameter generally larger than that of the rifle bore. A bushing 20, preferably of an 85 Shore A durometer elastomer such as Buna-N, is press fitted onto the forward end of section 16*a* and tapers inwardly for completely seating in the throat or breech end opening of the rifle bore in ring R after having been slid through bridge B. The length of the tube 16 is sufficient to extend rearwardly behind bridge B when bushing 20 is fully seated. A sleeve 24, slidable through bridge B as well as along the outside of tube portion 16*a*, carries a radially extending lock pin 22 with one end threaded through the side of sleeve 24 for tightening against tube portion 16*a*. With bushing 20 fully seated in communication with the rifle bore, sleeve 24 may be slid through bridge B into a position where lock pin 22 engages the forward bearing surface of a bolt handle recess or slot S in the rifle stock. Sleeve 24 is then locked in position by screw-tightening lock pin 22 against tube portion 16*a*.

Rearward tube portion 16*b* is greater in transverse cross section than forward portion 16*a* to provide an inclined, generally rearwardly facing, planar surface 16*d* which traverses bore 18 at an angle in a range of 15–25°, preferably approximately 20° across the longitudinal axis of tube 16. Tube 16 is preferably manufactured by extruding a strong, durable metal such as anodized 6061-TC aluminum alloy, or equivalent, with an outside diameter of portion 16*b* equal to the breadth of surface 16*d*, and then either machining the extrusion to form forward portion 16*a* or threading the rear end of the forward portion 16*a* into the intermediate portion 16*b*.

Figure 2:
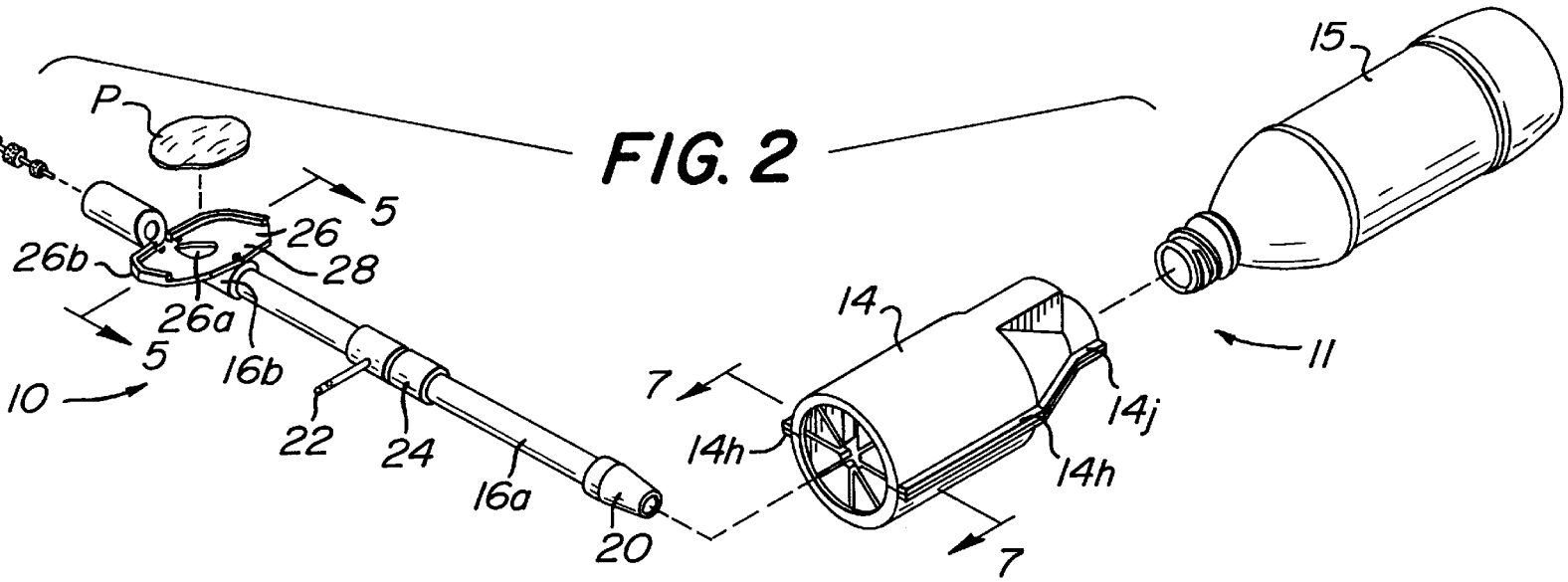
FIG. 2 is an isometric view of components of the system of FIG. 1 in spatial relation.
Figure 5:
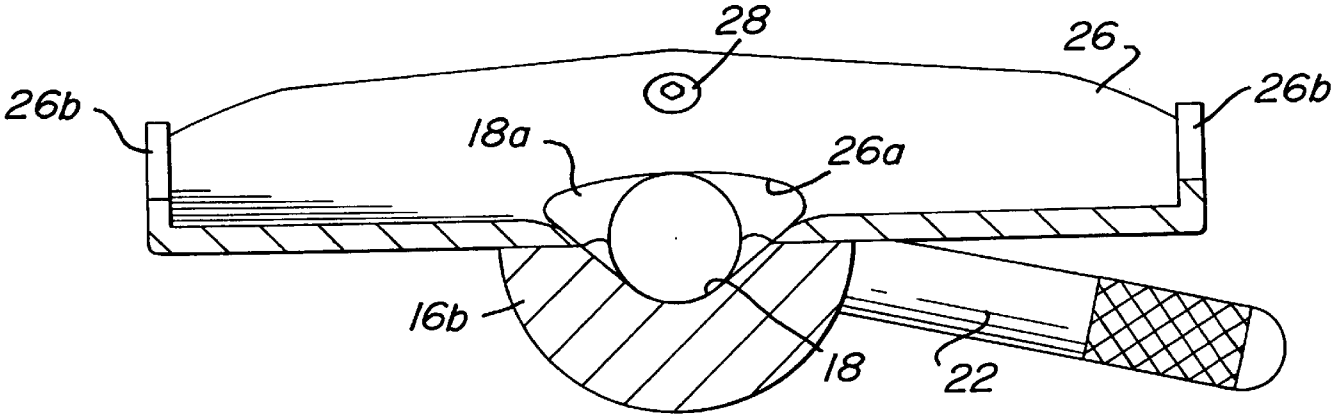
FIG. 5 is an enlarged, transverse cross section through the brush and patch guide taken along the line 5—5 of FIG. 2.

A patch support platen 26 of an alloy like that of tube 16 is attached to surface 16*d* by fasteners 28. As best seen in FIG. 2 and 5, platen 26 includes a pear-shaped aperture 26*a* contiguous with a funnel-like opening 18*a* in intermediate portion 16*b* which smoothly converges into the cylindrical inner surface of bore 18. The shape of aperture 26*a* and opening 18*a* allows a cleaning patch P to be disposed on the platen 26 in the path of movement of cleaning rod 13 and inserted in an unobstructed, low resistance manner into bore 18. A rim 26*b* around the rearward edge of platen 26 helps to retain patch P in place, and allows excess cleaning solvent applied to patch P to drain into the path of rod 13.

Referring now to FIGS. 2 and 6–8, patch collector 11 comprises a hollow cylindrical adaptor 14, preferably molded of a high density polyethylene, mounted on the muzzle M of the rifle, and a conventional narrow neck, screw-top container 15, such as a 16-ounce blow-molded PET soda pop bottle disposed co-axially with the gun bore. Container 15 is preferably transparent to enable the condition of the patches discharged at the muzzle to be observed. An elastomeric circular insert disc 32, secured in an annular race 14*a* at one end 14*b* of adaptor 14, has radial slots 32*a* and 32*b* communicating with each other at the center to form a star-shaped port 33. When the rifle muzzle M is passed through the port 33, inwardly projecting points of insert 32 formed by each pair of adjacent slots 32*a*, elastically deflect into the adaptor and grip the outer surface of the muzzle. Slot 32*b* is wider than slots 32*a* to allow the front sight F of the rifle to pass freely into adaptor 14. The other end 14*c* of adaptor 14 has a frusto-conical portion that tapers to a neck section 14*d* having internal threads threadedly engageable with conventional external threads on the neck of container 15. A radial recess 14*e* is formed to receive front sight F in the tapered end portion 14*c* and is fixed in radial alignment with slot 32*b* by adaptor keys 14*f* mating with keyways 32*c*. Insert 32 is preferably made of a synthetic elastomer such as 70 Shore A durometer butyl-N rubber. Preferably, the adaptor 14 is molded of two identical sections which have lengthwise extending flanges 14*h* that are ultrasonically welded along their lengths and riveted at the internally threaded neck end as by rivets 14*j* (FIG. 2).

Figure 9:
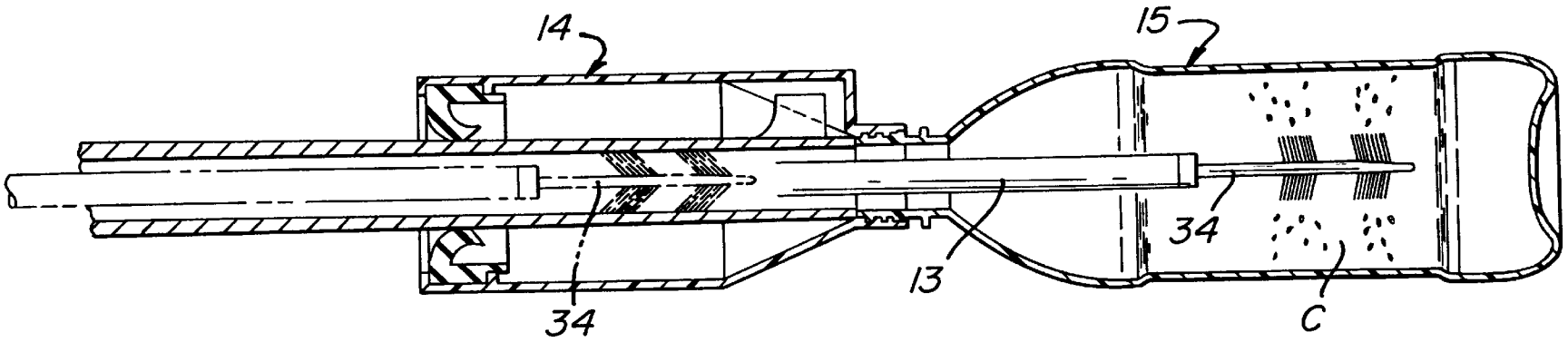
FIG. 9 is a longitudinal cross section through the brush and patch guide and showing it in use collecting patches and solvent.

FIG. 9 shows the solvent and patch collector 15 in use with a wire brush cleaner 34 attached to cleaning rod 13. Typically, as the brush 34 emerges from the muzzle of the gun, the bristles tend to spring outward and splatter solvent. Container 15 prevents the solvent from spreading while collecting it for proper disposal.

A method for cleaning the bore of a rifle with the apparatus as above described begins with mounting patch collector 11 on the rifle 10 by inserting the muzzle of the barrel through the aperture 33 of insert 32 until front sight 34 registers in recess 14*d* and the muzzle abuts neck 14*d*. With the bolt removed, patch guide 10 is slid through the bridge B until bushing 20 seats in the throat or breech end of the rifle bore. Guide 10 is locked in place by first positioning sleeve 24 where lock pin 22 will engage bolt-handle slot S in the rifle stock and then screw-tightening lock pin 22 against tube 16. The position of sleeve 24 is thereby set for a specific rifle but must be reset, of course, for different model rifles.

Figure 3:
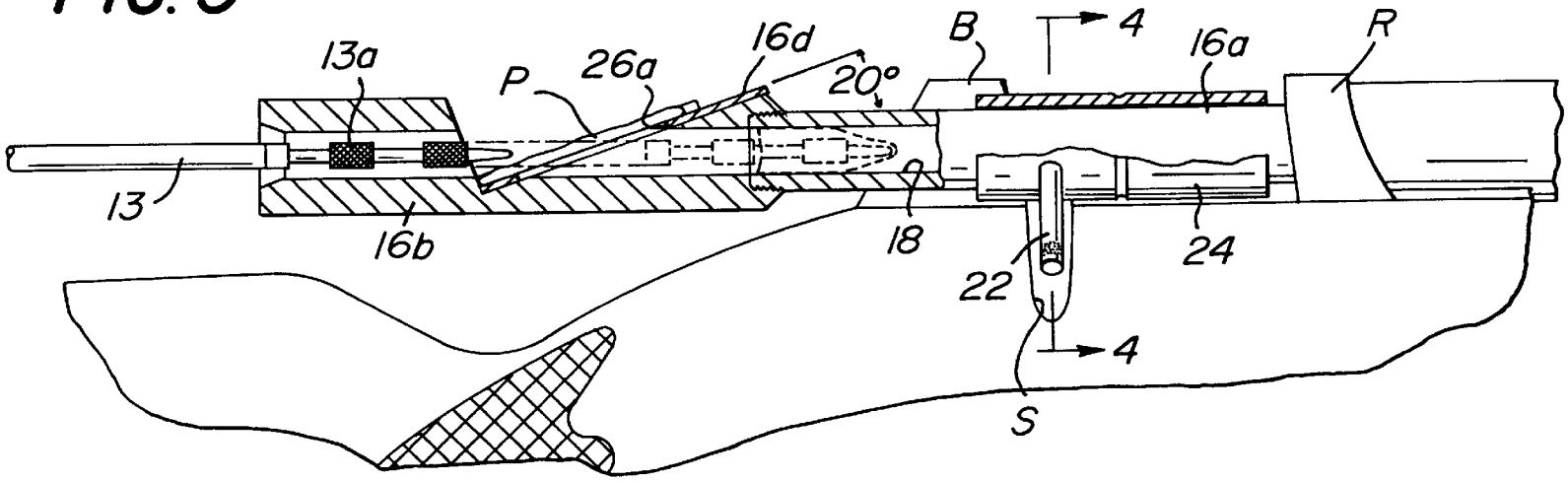
FIG. 3 is a longitudinal view, partially in cross-section, of a brush and patch guide of the system of FIG. 2 shown mounted in the breech of the rifle.
Figure 6:
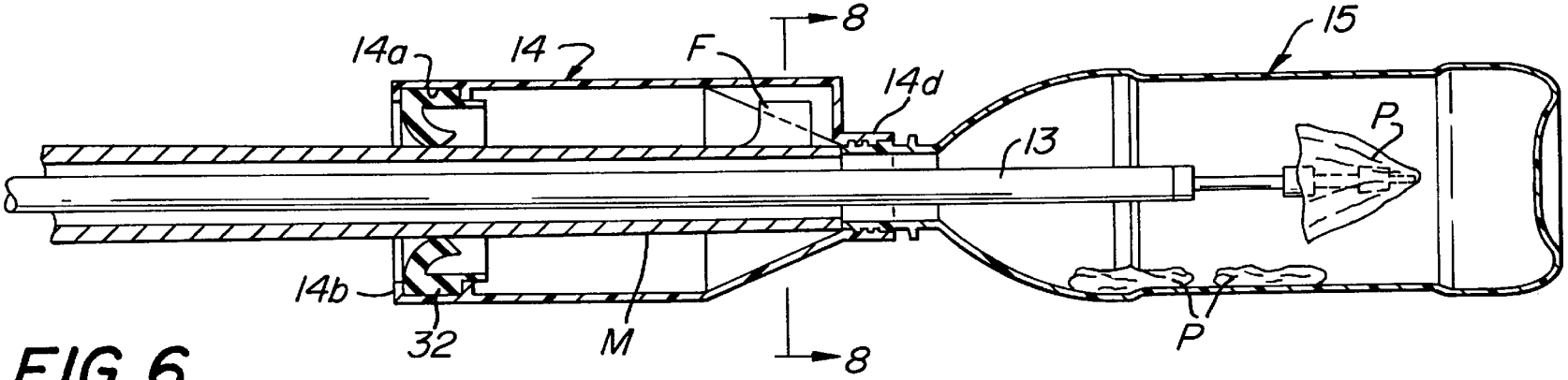
FIG. 6 is an enlarged longitudinal cross section of the solvent and patch collector of FIG. 2 shown installed on the muzzle end of the rifle and receiving a cleaning patch.

Before a cleaning patch is pushed through the rifle bore, it is recommended that an appropriately sized wire brush, saturated with solvent, be run through the bore to loosen and clean out coarse residue. The collection apparatus will be especially appreciated in this process as it will confine any solvent sprayed by the brush as it emerges from the muzzle of the rifle and enters the container. Then, as shown in FIG. 3, a clean dry patch P, is placed on patch support platen 26, and with a jag tip 13*a* of appropriate size attached to cleaning rod 13, the rod is pushed through tube 16 capturing patch P as the tip passes through the inclined plane of platen aperture 26*a* and opening 18*a*. After patch P enters container 15, as shown in FIG. 5, rod 13 is retracted leaving the soiled patch P in the container 15. The process is repeated with a new patch each time until there is no evidence of dirt present on a patch.

Some of the many advantages and novel features of the invention should now be readily apparent. For example, a system is provided for capturing and guiding a cleaning brush or patch into the breech end of the bore of a gun and for collecting excess cleaning solvent and patches in a closed container at the muzzle. The patch is supported on a cleaning rod guide that enables the patch to be captured, hands-free, by the tip of the rod before it enters the gun bore, and soiled patches may be collected, hands-free, thereby preventing the solvent from soiling the user's hands and collecting on the gun, clothing or any surrounding surfaces. A bore cleaning system is provided which is ecologically friendly, quick and easy to use, and relatively inexpensive to manufacture.

It will be understood, of course, that various changes in the details, materials, and steps and arrangement of parts, which have been herein described and illustrated in order to explain the nature of the invention, may be made by those skilled in the art within the principle and scope of the invention as expressed in the appended claims.

We claim:

1. Apparatus for use in cleaning the bore of a gun barrel having a breech and a muzzle comprising:

a guide tube having a forward end portion adapted to engage the gun barrel breech and having a rearward end portion remote from said gun barrel breech, said tube adapted to axially slidably receive a cleaning rod having a tip, said tube having a lateral opening rearwardly of said forward end;

a cleaning patch holder provided on said tube adjacent to said opening for receiving a cleaning patch and disposing it across said tube opening;

means for releasably locking said tube into said gun with said tube forward end engaged in the gun barrel breech; and collector means for releasably engaging said gun barrel muzzle to collect said patch after it has been displaced by the cleaning rod tip into the tube opening and through the muzzle.

2. Apparatus according to claim 1 wherein said tube has an edge extending at an acute angle across its longitudinal axis to provide said lateral opening and said cleaning patch holder includes means providing a planar surface surrounding said edge.

3. Apparatus according to claim 2 wherein said cleaning patch holder surface providing means including a platen extending transverse to said guide tube and inclined at said acute angle.

4. Apparatus according to claim 3 wherein said platen has a rim extending around at least lower edge portions of its periphery to assist in positioning the cleaning patch and directing solvent.

5. Apparatus according to claim 4 wherein said patch receiving surface is disposed at an angle in a range of about 15° to about 25° relative to the longitudinal axis of the guide tube.

6. Apparatus according to claim 1 wherein said collector means includes a container and an adaptor for releasably connecting said container to said muzzle.

7. Apparatus according to claim 6 including means for releasably connecting said container to said adaptor.

8. Apparatus according to claim 6 wherein said adaptor includes a hollow tubular member having open opposite ends, resilient means on one of said ends providing a port for slidably receiving said gun muzzle, and coupling means at the other of said ends for providing said container connecting means.

9. Apparatus according to claim 8 wherein said resilient means is provided by an elastomeric disc having a plurality of radially-extending slots defining flexible segments providing said port for receiving said gun muzzle.

10. Apparatus according to claim 8 wherein said adaptor has a frusto-conical portion adjacent said container coupling end for receiving said gun muzzle and a lateral chamber for receiving a gun sight.

11. Apparatus according to claim 10 wherein said container coupling end of said adaptor member is aligned axially with said port and is internally threaded for threadedly engaging external threads on a conventional blow-molded plastic bottle for disposing it coaxially with said gun barrel.

12. A cleaning patch holder for use in cleaning a breech-loading gun bore, comprising:

an elongate guide tube having a forward end portion adapted to be received in a gun breech and a rearward end portion remote from the gun breech, said guide tube having a lateral aperture for admitting a cleaning patch into the interior of the tube;

a cleaning patch holder platen surrounding said aperture and disposed at an acute angle relative to said guide tube, said patch holder platen extending across the longitudinal axis of the guide tube; and means slidable on said guide tube between said platen and said forward end portion for releasably locking said guide tube in operative relation relative to said gun breech.

13. The cleaning patch holder according to claim 12 wherein said platen is disposed at an angle in a range of about 15° to about 25° relative to said longitudinal axis.

14. The cleaning patch holder according to claim 13 wherein said platen has a rim extending about at least lower portions of its periphery for aiding in positioning a cleaning patch across said tube aperture.

15. An adaptor for use in collecting a cleaning patch and cleaning fluid discharged from the muzzle end of a gun during cleaning of its bore, comprising:

a tubular member having openings at opposite ends thereof, means at one of said ends providing a resiliently-deformable port for receiving the gun muzzle, and means at the other of said ends for releasably connecting a disposable container thereto.

16. The adaptor according to claim 15 wherein said resiliently-deformable port means is provided by an elastomeric disc having a plurality of radially-extending slots defining segments terminating centrally in spaced relation to form said muzzle-receiving port.

17. The adaptor according to claim 15 wherein said tubular member has a frusto-conical section adjacent said other of said ends for guiding said muzzle toward said container connecting means.

18. The adaptor according to claim 17 including a lateral enlargement in said frusto-conical section for receiving a gun sight on the muzzle.

19. The adaptor according to claim 15 wherein said container releasable connecting means includes internal threads on said tubular member for releasably threadedly receiving external threads on a conventional blow-molded container.

* * * * *